United States Patent [19]

Gable

[11] 4,397,465

[45] Aug. 9, 1983

[54] FLEXIBLE STRIP WITH ROLLING AND BENDING MEANS

[75] Inventor: Derek J. Gable, Rancho Palos Verdes, Calif.

[73] Assignee: Mattel, Inc., Hawthorne, Calif.

[21] Appl. No.: 312,580

[22] Filed: Oct. 19, 1981

[51] Int. Cl.[3] ..... A63F 9/14; A63F 18/02; B29C 17/02

[52] U.S. Cl. ..... 273/86 D; 238/10 A; 264/339; 273/86 R

[58] Field of Search ..... 46/1 K, 202, 257–261; 238/10 A, 10 B, 10 C, 10 E, 10 F; 72/176, 274; 273/86 R, 86 D

[56] References Cited

U.S. PATENT DOCUMENTS

| | | | |
|---|---|---|---|
| 557,196 | 3/1896 | Dring | 72/176 |
| 1,019,805 | 3/1912 | Koenig | 72/176 X |
| 2,068,403 | 1/1937 | Ekstrom | 46/202 X |
| 2,077,508 | 4/1937 | Bierer | 264/339 X |
| 2,574,067 | 11/1951 | Seidman | 238/10 |
| 3,675,361 | 7/1972 | Schlau et al. | 46/202 X |
| 3,780,235 | 12/1973 | Deyerl et al. | 191/13 |

*Primary Examiner*—F. Barry Shay
*Attorney, Agent, or Firm*—Reagin & King

[57] ABSTRACT

A toy vehicular track formed of a thin strip of flexible material having a pair of lines parallel to its length formed to enhance bending. The strip is connected at one end to a drum the rotation of which causes the strip to be rolled on the drum for storage. The strip fits through a shaper so that when it is pulled from the drum and through the shaper it is bent along the aforementioned lines so that a track with curbs for a toy vehicle is formed.

7 Claims, 11 Drawing Figures

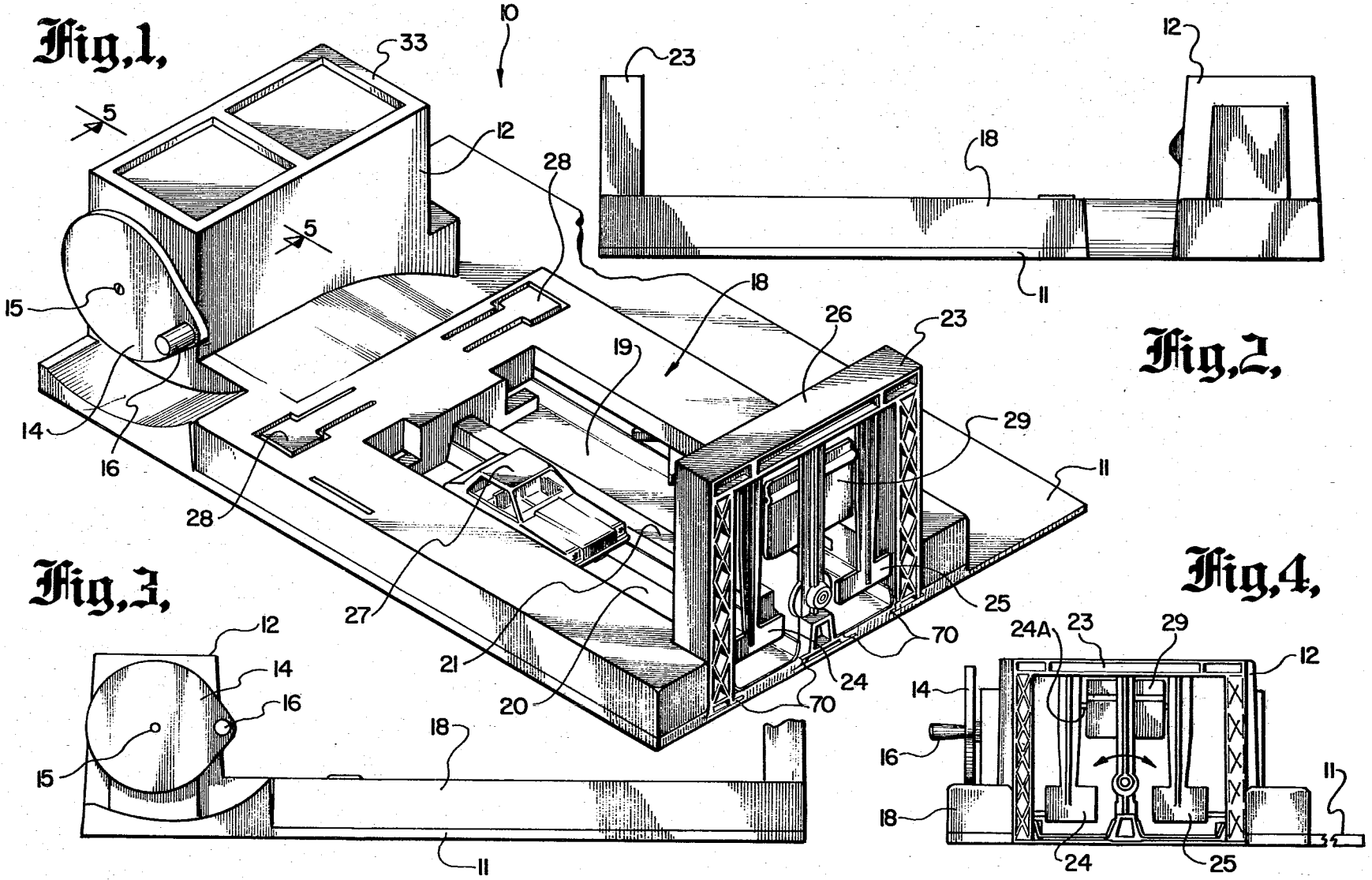
Fig. 1,
Fig. 2,
Fig. 3,
Fig. 4,
10
11
12
14
15
16
18
19
20
21
23
24
24A
25
26
27
28
29
33
70
5

Fig. 7
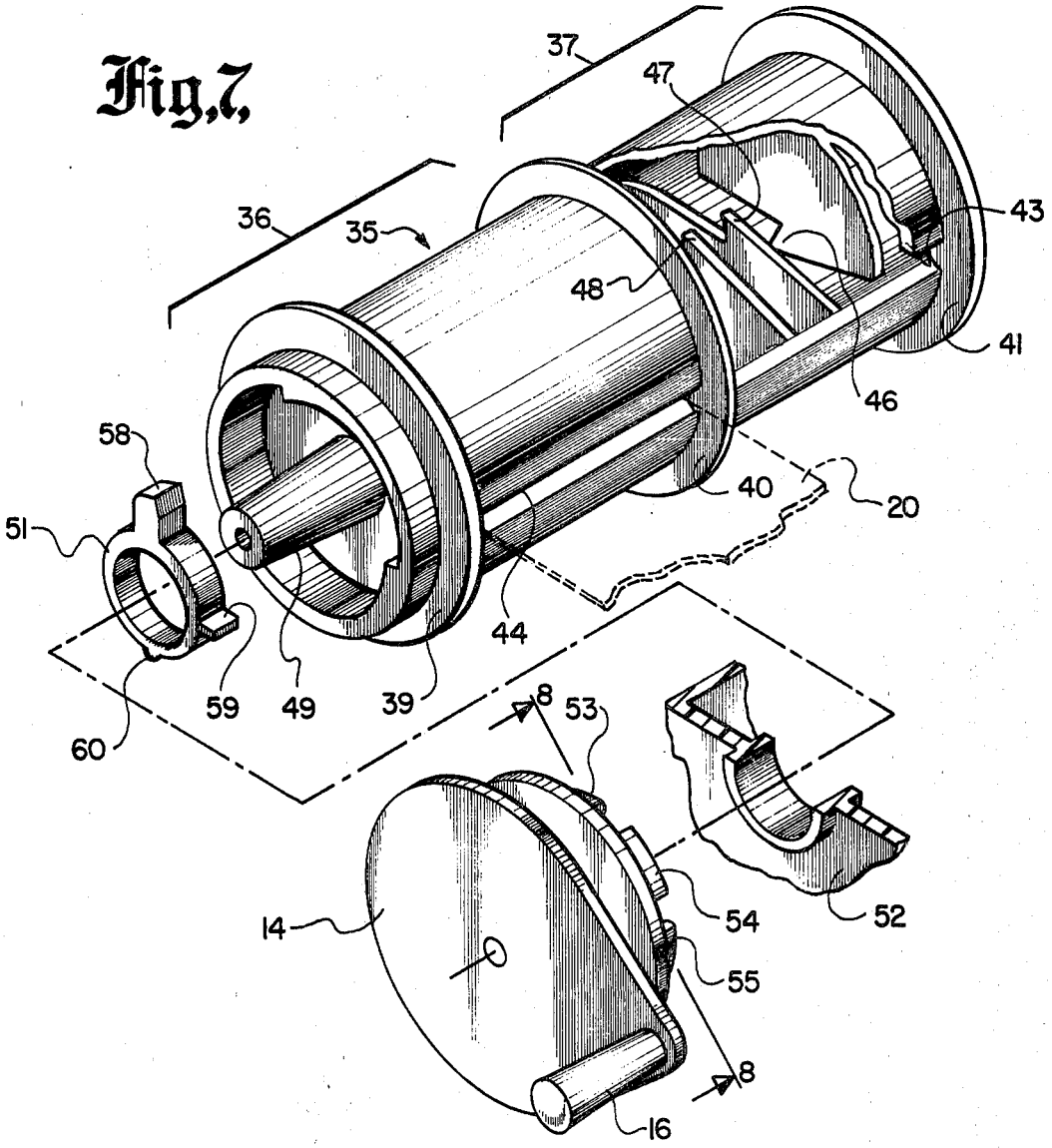
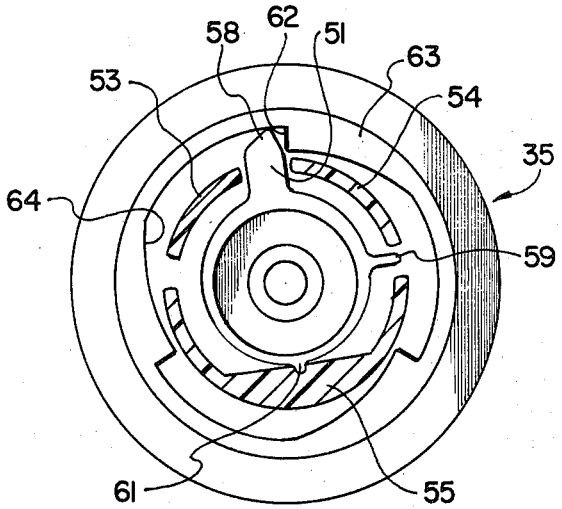
Fig. 8
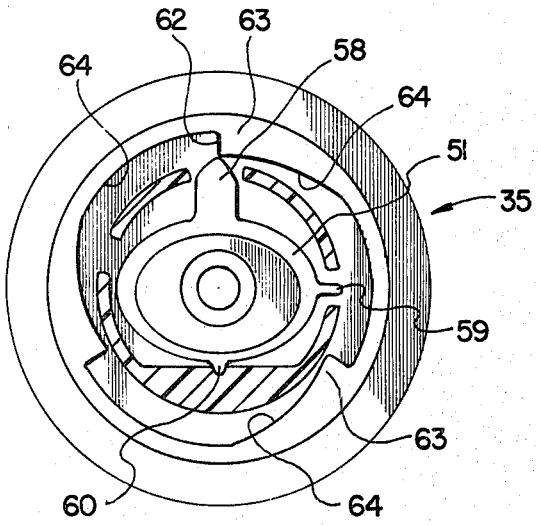
Fig. 9

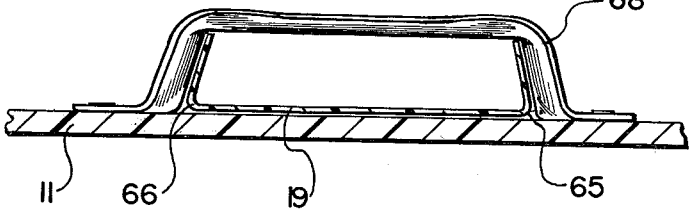
Fig. 11,
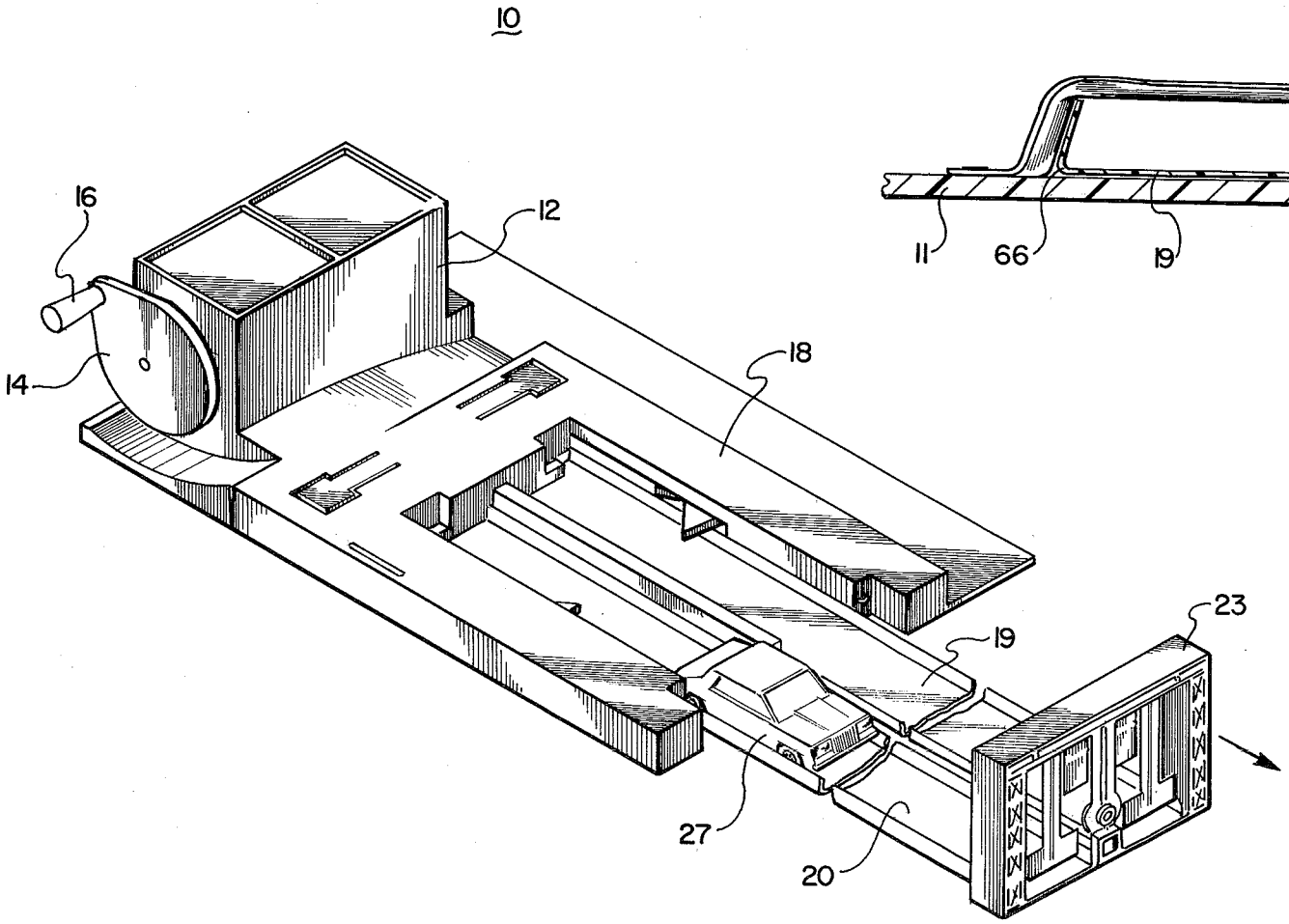
Fig. 10,

FLEXIBLE STRIP WITH ROLLING AND BENDING MEANS

BACKGROUND OF INVENTION

This invention relates to toys and, more particularly, to tracks for toy vehicles.

Many tracks for toy vehicles have been developed over the years. For example, slot cars have elaborate racing track layouts which are, in general, fixed and unmovable. Other types of toy vehicles have track arrangements which, even though they may be disassembled, occupy a substantial amount of space when disassembled and are clearly inconvenient to move from place to place because of their bulk and weight.

Attempts have been made to devise portable track arrangements such as that shown in U.S. patent application Ser. No. 110,974, entitled Toy Racing Set, invented by G. L. Lambert, Jan. 10, 1980, and assigned to the assignee of the present invention, (now U.S. Pat. No. 4,285,157); but such arrangements are for limited use in restricted areas and can not be connected with large scale racing layouts.

It is, therefore, an object of the present invention to provide a new and improved race track for toy vehicles.

It is another object of the present invention to provide a track for toy vehicles which is quite compact, light in weight, and easily portable, yet may be connected with other track components to provide a large track layout.

SUMMARY OF THE INVENTION

These and other objects of the invention are accomplished by a toy track which utilizes a strip of flat, thin, flexible material which may conveniently be pulled through shapers. The material assumes a shape in cross section having a flat, essentially horizontal, surface with end portions projecting upwardly at approximately right angles to the flat surface. The flat surface forms a path for a vehicle which is maintained thereon by the upstanding (end portions) sides. As much of the track material may be unwound as is necessary to provide the length of track desired in any particular arrangement. After the track has been used, it may be rerolled onto the drum where it assumes a flat shape requiring a very small space.

Other objects, features, and advantages of the invention will become apparent from a reading of the specification when taken in conjunction with the drawings in which like reference numerals refer to like elements in the several views.

BRIEF DESCRIPTION OF THE DRAWINGS

FIG. 1 is a perspective view of a track housing arrangement constructed in accordance with the invention;

FIG. 2 is a right side view of the arrangement shown in FIG. 1;

FIG. 3 is a left side view of the arrangement shown in FIG. 1;

FIG. 4 is a front view of the arrangement shown in FIG. 1;

FIG. 7 is an exploded view, partially cut away, showing a drum which may be utilized in the arrangement to FIG. 1;

FIGS. 8 and 9 are cross-sectional views taken along line 8—8 of FIG. 7;

FIG. 10 is a perspective view of the arrangement of FIG. 1; and

FIG. 11 is a front view of a shaper used in the arrangement of FIG. 1.

DESCRIPTION OF THE PREFERRED EMBODIMENT

Figure 5:
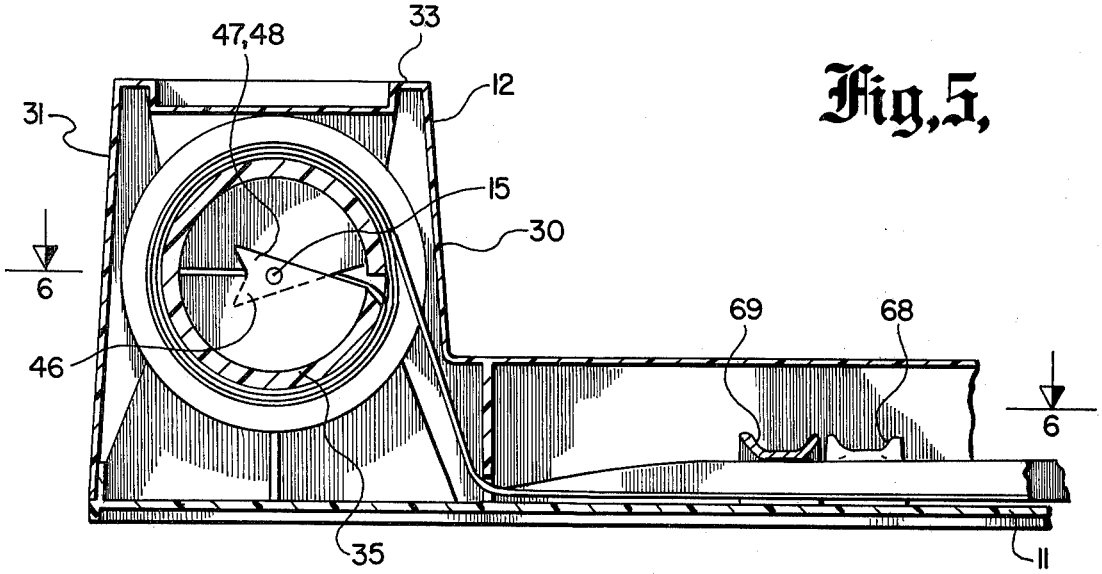
FIG. 5 is a cross-sectional view taken along lines 5—5 in FIG. 1 showing a portion of the drum arrangement of FIG. 1.

Referring now to the drawings and, more particularly to FIG. 1, there is shown a perspective view of an arrangement 10, which may be used as a portion or the whole of a toy track layout. The arrangement 10 includes a base 11 which may in a preferred embodiment be constructed of a moldable plastic material in essentially a flat planar rectangular shape. The base 11 supports a housing 12 for a drum or roller (not shown in FIG. 1). The roller is rotated by the rotation of an essentially circular plate 14 about an axis 15 which runs horizontally through the central portion of the housing 12 and is the axis for the roller contained therein. The plate 14 is rotated by a handle 16 mounted thereto, which an operator may grip and rotate.

Also mounted to the base 11 is an accelerator 18 for two vehicles which is better shown and described in co-pending patent application entitled Toy Vehicle Accelerator filed concurrently herewith, invented by Virgil Wayne Wulff, and assigned to the assignee of the present invention. The accelerator 18 provides a means for imparting a high initial velocity to a toy vehicle. The accelerator 18 has positioned therein a pair of tracks 19 and 20 which are constructed of a material such as Mylar brand polyester resin, manufactured by E. I. Dupont de Nemours, Wilmington, Del. The two tracks 19 and 20 are separated by a divider 21 and are connected at their extremities in the embodiment shown in FIG. 1 to a finish gate 23. Finish gates of the type such as gate 23 have been sold for many years.

As will be understood from the description that follows, the two tracks 19 and 20 are each firmly affixed to the finish gate 23 so that they are unrolled from a roller within the housing 12 when the gate 23 is pulled to the right away from the base 11 (as is more clearly shown in FIG. 10.) The gate 23 has a pair of arms 24 and 25 which are swingably connected to an upper horizontal element 26 and each of which carries a cam 24A used for releasing an inverted pendulum 29 to signal that a vehicle has crossed the finish line. Positioned on track 20 in the embodiment shown in FIG. 1 is such a vehicle 27.

The approximate relative dimensions of the arrangement 10 shown in FIG. 1 are better illustrated by the side views shown in FIGS. 2 and 3. FIG. 5 illustrates a part of the arrangement 10 (shown in FIG. 1) in cross section. That part includes the housing 12 and a portion of the base 11. The housing 12 includes an upstanding wall 30, an upstanding wall 31, a cover 33, and a roller 35. The roller 35 is shown in FIG. 5 as an end view of a cylinder which rotates on supports about the axis 15 referred to above in describing FIG. 1.

Figure 6:
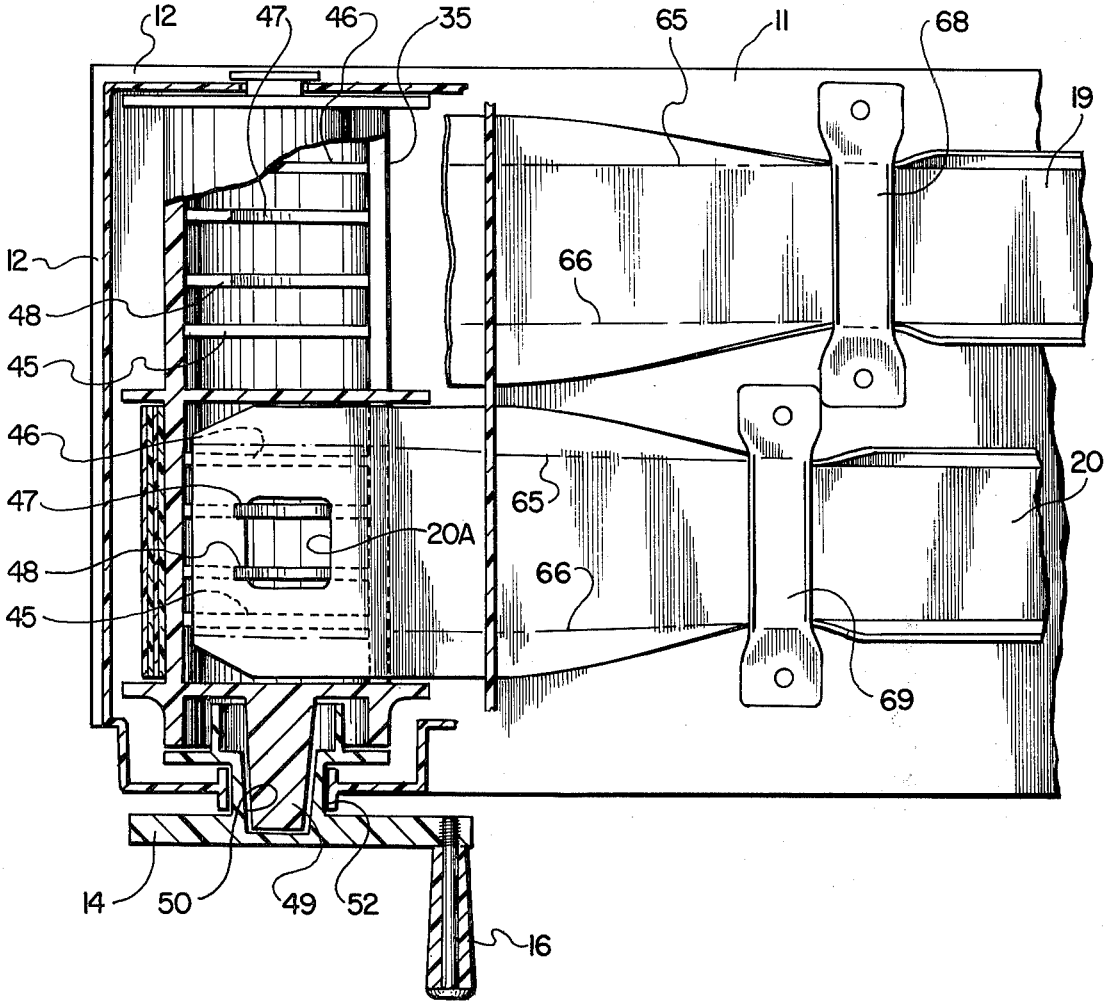
FIG. 6 is a top view, partially in cross-section and partially cut away, of the arrangement shown in FIG. 5 illustrating the shapers thereof.

As may be seen in FIG. 6 (which is a cross-sectional view of the same portion of the arrangement 10 shown in FIG. 5 taken from the top), the roller 35 extends along the axis 15 and is positioned within the housing 12 so that the rotation of the plate 14 causes the roller 35 to move about the axis 15. The roller 35 is better shown in FIGS. 7, 8, and 9. Particularly, in FIG. 7 a perspective view of the roller 35 removed from the housing 12 is shown. The roller 35 has two sections 36 and 37 which are formed by dividing fins 39, 40, and 41. Upon the sections 36 and 37 of the cylinder forming roller 35 are wound the materials forming the tracks 19 and 20 of the arrangement 10.

In a preferred embodiment, the tracks 19 and 20 are constructed of a flexible material such as Mylar having a thickness of 0.010", a width of 1¾", and a length of 8 feet. Other flexible materials than Mylar may be used to form the tracks 19 and 20. The ends of the tracks 19 and 20 are inserted through slits 43 and 44 in the cylindrical outer wall of the roller 35 and are engaged in a well known manner by projections 45, 46, 47, and 48 enclosed within the cylinder which forms the roller 35. As will be obvious to those skilled in the art, when a sheet of Mylar is forced through the slit 43, it continues between the projections 45, 46, 47, and 48. Holes, like the hole 20A shown in FIG. 6 for track 20, may conveniently be cut in the ends of tracks 19 and 20 to accept projections 47, 48. Projections 45, 46 will then engage the tracks outside of projections 48, 47, respectively, so that the ends of the tracks 19 and 20 are retained within the interior of the roller 35. Tracks 19 and 20 may then be roller as strips upon the roller 35.

Projecting from the end of roller 35 is a shaft 49 which is adapted to fit in a recess 50 (FIG. 6) in the back surface of plate 14. The shaft 49 fits through a clutch release piece 51 and is held to rotate by a support 52 in housing 12. The support 52 allows the roller 35 to rotate upon the axis 15 when the handle 16 is moved by the operator.

The back side of plate 14 has projections 53, 54, 55 adapted to hold piece 51 loosely so that a driving projection 58 fits between projections 53 and 54, a positioning projection 59 fits between projections 54 and 55, and a projection 60 fits in a detent recess 61. When the plate 14 is rotated clockwise, the projection 58 bears against an end 62 of a cylindrical ramp 63 on the end of the roller 35 and rotates the roller 35 to wind the tracks 19 and 20. Once the tracks are retracted to the positions shown in FIG. 1, further clockwise rotation of plate 14 causes piece 51 to deform (see FIG. 9) so that projection 58 slides past end 62 without rotating the roller 35. When the plate 14 is rotated counter-clockwise, the projection 58 is forced inwardly by a ramp surface 64 causing the piece 51 to deform so that the roller 35 does not rotate. This prevents overwinding and also provides unidirectional rotation of the roller 35.

The roller 35 (including all of its portions such as the projections 46, 47, and 48), the shaft 49, the piece 51, the support 52, and plate 14 may all be constructed of moldable plastic material which is well known in the art and is easily shaped to form the intricate shapes necessary to the arrangement 10 shown herein.

The Mylar or other film which comprises the tracks 19 and 20 is wound upon the roller 35 by rotation of the plate 14 as an operator urges the handle 16 in a circular motion. As will be understood by viewing FIG. 6, the material winds around the roller 35 to form two rolls of flat material which lie in rolls which may be likened to rolls of photographic film. In the preferred embodiment, each of the strips which comprises the track 19 or the track 20 has a pair of bend lines running along its length and parallel to one another (designated in FIG. 6 as 65 and 66) which have been made weaker by manufacture, bending, or the like than the surrounding material. Each of the strips is also positioned between the base 11 and a shaper 68 or 69 which has a shape such as to cause the strips forming each of the tracks 19 and 20 to bend upwardly along the weakened lines 65 and 66 as the material is moved outward from the roll through the shapers 68 and 69 as seen in FIG. 6.

FIG. 11 is a view taken from the right side of FIG. 6 into the shaper 68 demonstrating the interior shape thereof. The shapers 68 and 69 are formed of a solid material such as a metal; they may have especially smooth surfaces within to facilitate pulling the tracks 19 and 20 therethrough. As may be seen from FIG. 11, the width of the open portion of the shaper 68 where it joins in the base 11 through which the strip of track 19 passes is essentially equal to the perpendicular distance between the bend lines 65 and 66 while the interior width of the shaper 68 narrows as it is further displaced from the base 11. Thus, as the material forming the track 19 is pulled through the shaper 68, the outer edges of the track material are folded inwardly along the bend lines 65 and 66 at slightly greater than right angles. A material such as Mylar when bent at a right angle along a line of weakness remains essentially at a right angle. Thus, the track 19 is bent to form curbs which will contain a vehicle within during vehicular motion.

When the material forming the tracks 19 and 20 20 is retracted by revolving the plate 14 and is wound up on the roller 35, the outer edges of the track are flattened by the roller 35 and maintained in this flattened position upon the roller 35. This allows the storage of a great amount of track material within a very small volume. It also allows the track material to be easily carried about from place to place. As will be understood a light weight material such as Mylar is easily portable and is much lighter than those materials used heretofor in the construction of tracks for toy vehicles.

FIG. 10 illustrates the manner in which a track may be pulled from the roller 35 in use. By applying pressure to pull the gate 23 in the direction shown by the arrow in FIG. 10, the two tracks 19 and 20 are withdrawn from the roller 35 (not shown in FIG. 10) and are shaped by shapers 68 and 69 (not shown but contained within the housing of the accelerator 18 at the left hand inner portion as shown in FIG. 10). The starting gate 23 may be withdrawn until sufficient track is provided for the particular use desired. Vehicles may then be raced using the accelerator 18 and the finish gate 23 in their normal manners to control the race. When the arrangement 10 is no longer needed, the plate 14 is rotated using the handle 16 and the tracks 19 and 20 are withdrawn into the housing 12 pulling the finishing gate 23 with them in a direction counter to the direction of the arrow shown in FIG. 10. As may be seen in FIG. 1, grooves 70 are provided at the base of the gate 23 so that plastic track of the more conventional type may be connected to the assembly 10 thereby making it a part of a larger track layout.

As will be obvious to those skilled in the art most of those portions of the housing 12, and base 11, the accelerator 18, and the gate 23 may be made of moldable plastic material well known in the art. Obviously, other materials might be used; but moldable plastic has been found to be quite convenient and provides the light weight desired in this particular invention.

While a preferred embodiment of the invention has been shown and described, it is to be understood that various other adaptations and modifications might be made within the spirit and scope of the invention.

What is claimed is:

1. A track for a toy vehicle comprising a strip of flexible material having a pair of bending lines running parallel to its length, a roller attached to one end of the strip, means for bending the strip along the lines at an angle to the main body of the strip to form curbs along the strip to contain a toy vehicle, means for drawing said strip away from said roller and bending means, and means mounting said roller and said bending means in fixed spaced relation whereby said strip may be drawn through said bending means toward and away from said roller.

2. A track as in claim 1, said mounting means further comprising a base, means for rotatably mounting the roller to the base, and wherein the means for bending the strip along the lines comprises a shaper attached to the base through which the strip may be drawn to cause it to bend.

3. A track as in claim 2 in which the shaper and the base form an opening through which the strip may be drawn having a dimension along the base approximately equal to the distance between the bending lines, and having a pair of sides approximately perpendicular to the base, each side being approximately equal to the distance between the bending lines and the sides of the strip.

4. A track as in claim 1 in which the strip comprises a polyester sheet, and in which the bending lines are formed by prebending the sheet.

5. A track as in claim 1 further comprising means for rotating the roller in one direction only.

6. A track as in claim 1 further comprising means for stopping the roller from rotating when the strip is in a completely retracted position.

7. A toy racing arrangement comprising a pair of retractable tracks each comprising a strip of flexible material, a roller attached to one end of each strip, means for bending each of the strips along lines running parallel to the length of the strip and at an angle to the main body of the strip to form curbs along each strip to contain a toy vehicle, means for drawing said strips away from said roller and bending means, and means mounting said roller and said bending means in fixed spaced relation whereby said strips may be drawn through said bending means toward and away from said roller.

* * * * *